US005299394A

United States Patent [19]

Surdacki

[11] Patent Number: 5,299,394

[45] Date of Patent: Apr. 5, 1994

[54] METHOD AND APPARATUS FOR BUFFING SPHERICAL PARTS

[76] Inventor: Richard G. Surdacki, 24480 S. Cromwell, Franklin Village, Mich. 48025

[21] Appl. No.: 852,383

[22] Filed: Mar. 16, 1992

[51] Int. Cl.[5] ..... B24B 1/00; B24B 9/00; B24B 5/02

[52] U.S. Cl. ..... 51/289 S; 51/289 R; 51/80 R; 51/108 R; 51/99

[58] Field of Search ..... 51/80 R, 80 A, 88, 89, 51/99, 103 R, 105 R, 108 R, 289 R, 289 S

[56] References Cited

U.S. PATENT DOCUMENTS

| | | | |
|---|---|---|---|
| 1,122,433 | 3/1914 | Smith . | |
| 1,441,893 | 1/1923 | Timken . | |
| 1,501,690 | 7/1924 | Strong . | |
| 1,516,269 | 11/1924 | Drissner . | |
| 2,232,843 | 2/1941 | Drissner et al. . | |
| 2,251,161 | 7/1941 | Packer et al. | 51/108 R |
| 2,566,059 | 8/1951 | Duncan | 51/88 |
| 3,024,578 | 3/1962 | Mushkin | 51/289 S |
| 3,133,383 | 5/1964 | Chapman | 51/289 R X |
| 3,167,884 | 2/1965 | Thompson | 51/289 R |
| 3,494,013 | 2/1970 | Gottschald . | |
| 3,795,956 | 3/1974 | Kalen . | |

FOREIGN PATENT DOCUMENTS

| | | | |
|---|---|---|---|
| 559227 | 9/1932 | Fed. Rep. of Germany | 51/108 R |
| 0037294 | 3/1977 | Japan | 51/289 S |
| 0212454 | 9/1988 | Japan | 51/289 R |
| 3-121759 | 5/1991 | Japan | 51/289 S |

OTHER PUBLICATIONS

"High Quality Indexing Rotaries", Hammond Brochure, 1953.

*Primary Examiner*—Bruce M. Kisliuk
*Assistant Examiner*—Bo Bounkong
*Attorney, Agent, or Firm*—Krass & Young

[57] ABSTRACT

A method and apparatus for buffing the balls of ball joint studs. The apparatus includes a frame structure including a base; an index table; a plurality of fixtures spaced circumferentially about the index table and each arranged to rotatably mount the shank portion of a stud, with the ball portion exposed, so that the stud may rotate about its lengthwise axis; an index drive mounted on the base and operative to indexingly move the table so that each fixture is moved successively through a loading station, a buffing station, and an unloading station; and first and second buffing wheels mounted on the frame structure at the buffing station with their respective peripheries arranged to buffingly engage opposed portions of the spherical surface of the ball of the stud as the ball is moved between the wheels by the index drive. Each buffing wheel is driven by a separate electric motor and the motors are separately pivotally mounted on the frame structure such that the respective wheels are biased by gravity against the ball. One wheel is arranged to exert an upward vertical component on the ball and the other wheel is arranged to exert a counteracting downward vertical component on the ball.

10 Claims, 3 Drawing Sheets

66
10
GF
GFv
112b
72
94
94a
72a
112
GFv
GF
112a 10
12
62
64
56
63
60
24
16
61
64
62
62b
63

METHOD AND APPARATUS FOR BUFFING SPHERICAL PARTS

BACKGROUND OF THE INVENTION

This invention relates to a method and apparatus for buffing spherical parts and more particularly to a method and apparatus for buffing the spherical or ball portions of ball joint studs of the type utilized in motor vehicle steering systems.

Ball joint studs form a critical part of motor vehicle steering systems and must be manufactured inexpensively but with great precision. In the manufacture of ball joint studs the parts are typically cold headed from steel stock, machined to form the ball and shank portions of the stud, threaded to form a threaded portion on the lower end of the shank portion, case hardened by carburizing, oil quenched, tempered and then subjected to a finishing step in which the oxides produced on the surface of the ball during the tempering step are removed to restore the required precise polished final finish.

The final finishing step to remove the oxides on the surface of the ball has been performed, for example, in a hand buffing operation utilizing handheld buffing machines, or in a vibratory tumbling operation in which the parts are placed in a container containing abrasive material to remove the oxides in response to tumbling movement of the container.

The hand buffing procedure is unsatisfactory since it is imprecise and since it is labor intensive, thereby adding considerably to the cost of the final ball joint stud.

The vibratory tumbling procedure is unsatisfactory since it often damages the previously formed threads on the shank portion of the stud, requiring rethreading after the tumbling operation, and since it creates toxic waste disposal problems associated with the periodic replacement of the abrasive material.

SUMMARY OF THE INVENTION

This invention is directed to the provision of an improved method and apparatus for buffing a spherical portion of a part.

More specifically this invention is directed to the provision of an improved method and apparatus for performing the final finishing operation on the ball portions of ball joint studs for use in automotive steering assemblies.

According to the invention methodology, the part, including a spherical portion, is mounted for rotation and opposite portions of the spherical surface of the spherical portion are engaged by first and second rotating buffing elements arranged to coact to buff substantially the entire spherical surface of the spherical portion of the part as the spherical portion rotates between the buffing elements. This methodology provides a simple and effective means of buffing the entire spherical surface.

According to a further feature of the invention methodology the elements comprise buffing wheels, the part includes a shank portion with the spherical portion at one end of the shank portion, the part is mounted for rotation about the lengthwise axis of the shank portion, one of the wheels is arranged to engage and buff substantially one hemisphere of the spherical surface, and the other wheel is arranged to engage and buff the other hemisphere of the spherical surface.

According to a further feature of the invention methodology, the wheels are urged by gravity against the spherical surface with one wheel arranged to exert a force on the part in one direction along the axis of the part and the other wheel arranged to exert a counterforce on the part in the opposite direction along the axis. This methodology allows the spherical surface to be totally buffed without displacing the part form the mounting structure.

The invention apparatus includes a frame structure; an index table; a plurality of fixtures spaced circumferentially about the index table and each arranged to rotatably mount the shank portion of a stud with the ball portion exposed, so that the stud may rotate about its lengthwise axis; an indexing drive operative to indexingly move the table so that each fixture is moved successively through a loading station, a buffing station and an unloading station; and first and second buffing wheels mounted on the frame structure at the buffing station with their respective peripheries arranged to buffingly engage opposed portions of the spherical surface of the ball portion of a ball joint stud moved therebetween by the index drive. This apparatus provides a simple and inexpensive means for removing the oxides from the surface of the ball of the ball joint stud without damaging the threads of the stud and without creating any environmental problems relating to toxic waste disposal.

DETAILED DESCRIPTION OF THE PREFERRED EMBODIMENT

Figure 1:
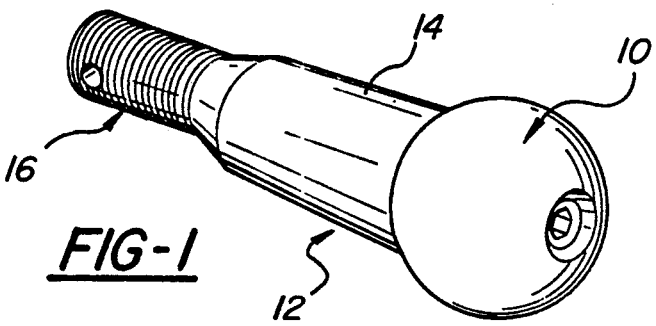
FIGS. 1 and 2 are perspective and side views respectively of a ball joint stud of the type used in motor vehicle steering systems.
Figure 2:
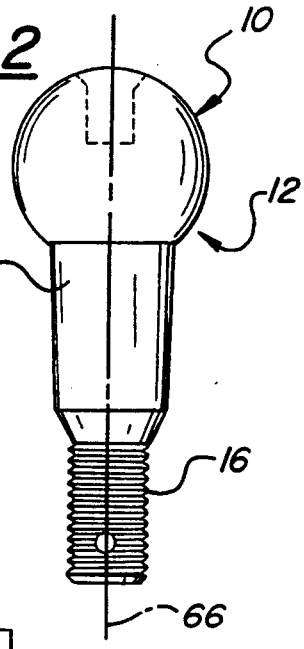
Figure 4:
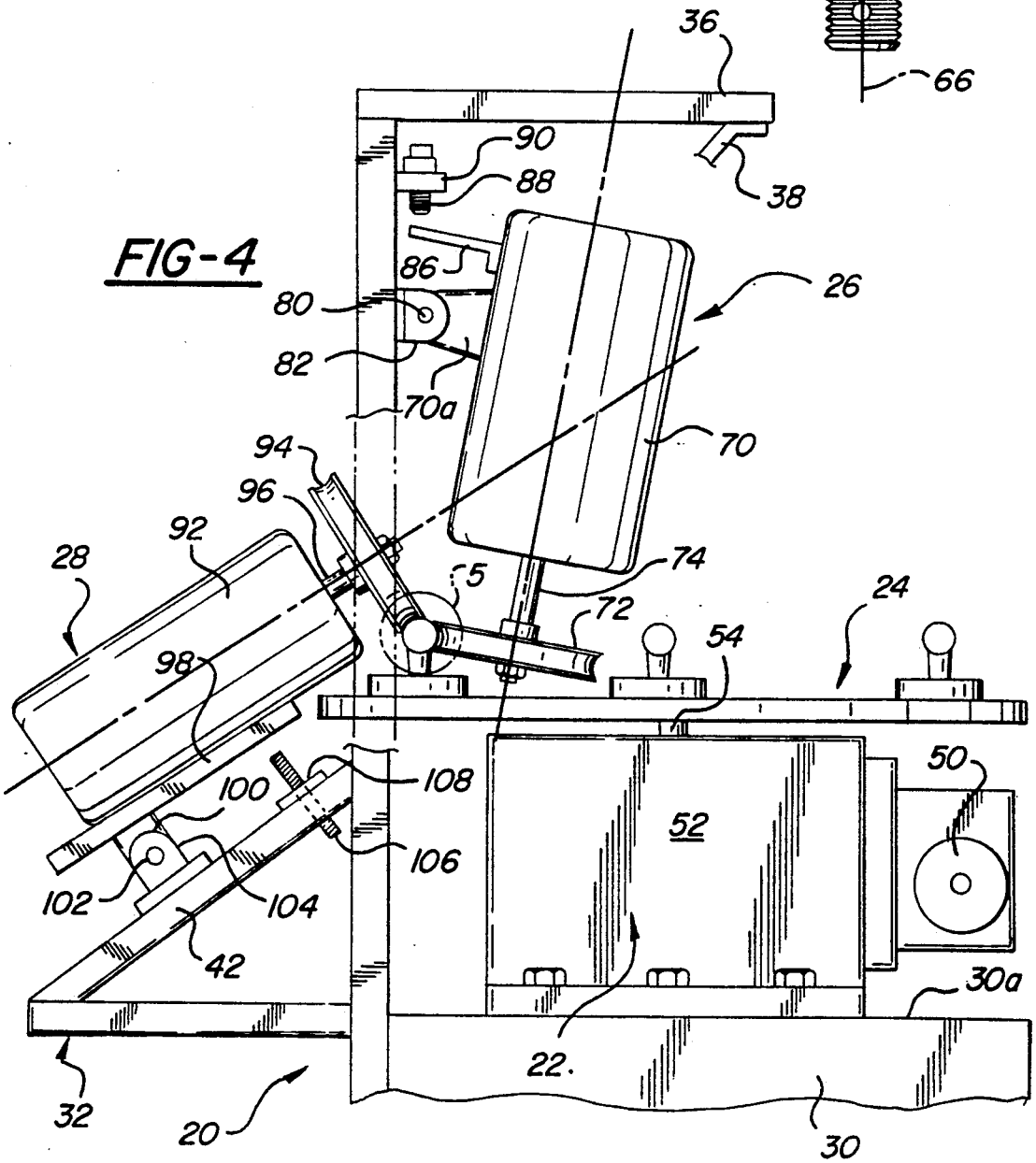
FIG. 4 is a fragmentary side view of the invention buffing apparatus.
Figure 3:
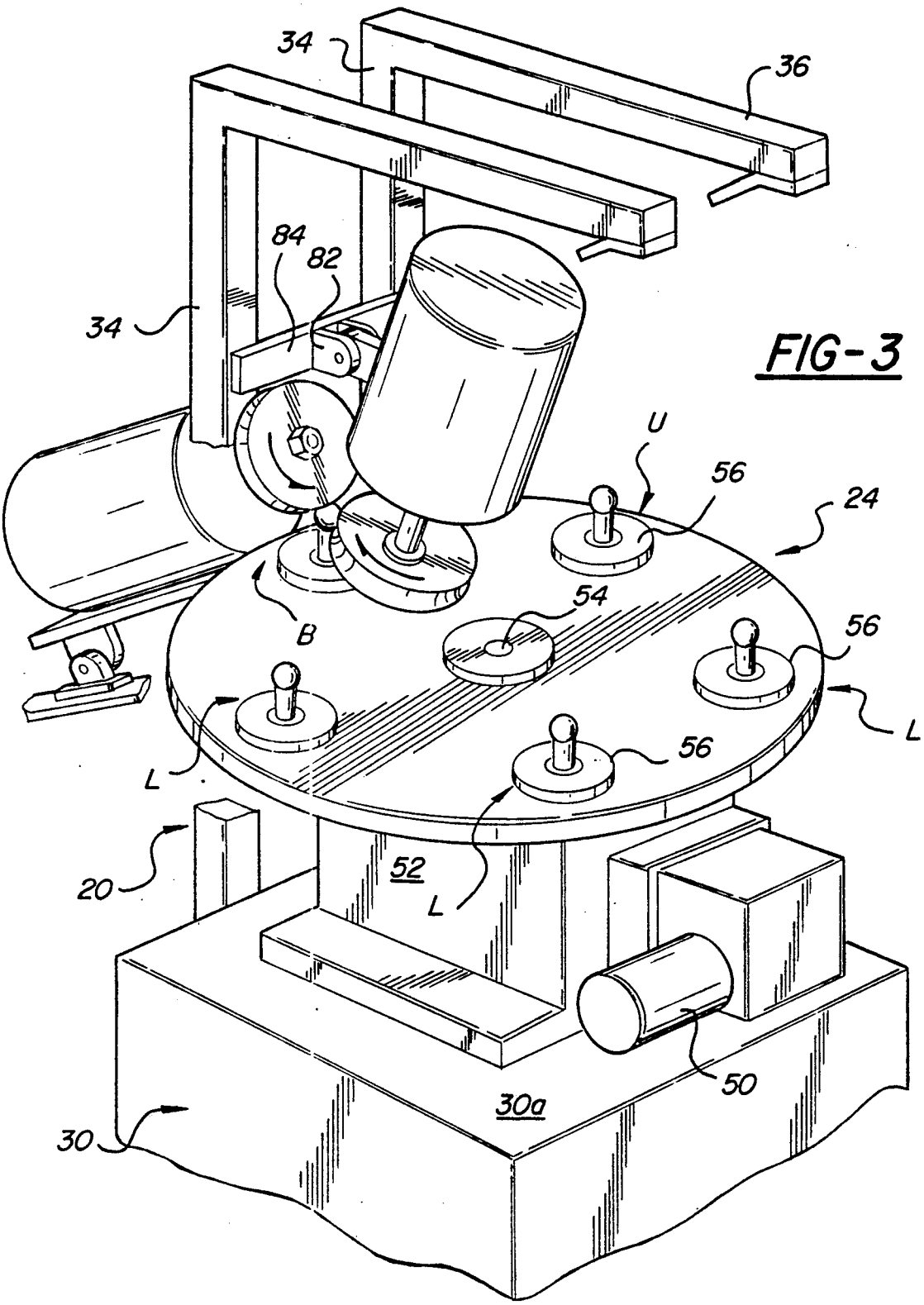
FIG. 3 is a perspective view of a buffing apparatus according to the invention especially suitable for buffing the ball portions of ball joint studs.

The invention method and apparatus is especially suitable for buffing the spherical surface of the spherical or ball portion 10 of a ball joint stud 12 of the type including the ball portion 10, a shank portion 14, and a threaded portion 16 at the end of the stud opposite the ball 10. It will be understood that ball joint studs are in common usage in motor vehicle steering systems to connect the outer ends of control arms to a steering knuckle to provide universal movement of the steering knuckle relative to the control arms. It is thus imperative that the surface of the ball 10 be perfectly spherical and be finely finished to provide proper operation of the associated ball joint.

Ball joint studs are typically formed by cold heading the part from suitable steel, machining the part to form the various portions of the stud, threading the lower end of the shank to form the threaded portion 16, case hardening and carburizing the part, subjecting the part to an oil quench, tempering the quenched part, and thereafter finally finishing the ball 10 to provide the proper final precision finish for the ball. This invention provides an improved method and apparatus for performing the final finishing operation on the ball 10.

The invention apparatus includes a frame assembly 20, an index drive 22, an index table 24, a first buffing wheel assembly 26, and a second buffing wheel assembly 28.

Frame assembly 20 includes a base 30 and a frame structure 3 secured to the base 30.

Frame structure 32 comprises a bar stock assembly and includes upright members 34, horizontal members 36 secured to the upper ends of upright members 34 and braced by brace members 38, lower horizontal members 40 secured to the lower ends of uprights 34, and angled members 42 extending between the outer ends of members 40 and upright members 34.

Index drive 22 is bolted to the upper face 30*a* of base 30 and includes an electric motor 50, a gear assembly 52, and an output shaft 54. Index drive 22 is of known form and may for example be of the type available from Emerson Power Transmission Corporation of Wheeling, Ill. as Camco RDM-601.

Index table 24 has a circular configuration and is secured centrally to the upper end of output shaft 54 of index drive 22 so that indexing movement of output shaft 54 generates indexing movement of table 24 about the central axis of shaft 54. Table 24 includes a plurality of fixtures or receptacles 56 provided at circumferentially spaced locations around the periphery of the table. Each fixture 56 is designed to rotatably mount the shank portion 14 of a ball joint stud 12 and includes an upper pillow block bearing 60 and a lower pillow block bearing 62 respectively secured to the upper and lower faces of table 22, and a hollow shaft 62 fixedly secured to the inner races 63 of the ball bearings 64 of upper and lower pillow block bearing 60 and 61. Hollow shaft 62 defines an upper large diameter bore 62*a* sized to receive the shank portion 14 of a ball joint stud 12 and a lower reduced diameter bore 62*b* sized to receive the threaded portion 16 of a ball joint stud. Each fixture 56 is thus capable of mounting a ball joint 12 for rotation about the central axis 66 of the stud with the shank portion 14 received in bore 62*a* and resting at its lower end on the shoulder 62*c* defined between bore portion 62*a* and 62*b*, the threaded portion 16 received in bore 62*b*, and the ball portion exposed above the fixture 56. The ball joint stud is thus free to rotate within the fixture 56 about its central axis and is maintained by gravity in the fixture so that the stud may be placed in the fixture by simply dropping the stud into the fixture and may be removed from the fixture simply by lifting the stud out of the fixture.

First buffing wheel assembly 56 includes a first electric motor 70 and a first buffing wheel 72 secured to the output shaft 74 of the motor 70 so as to be rotated by energization of the motor. Motor 70 may comprise for example a 1¼ horsepower AC motor with a nominal output speed of 3450 rpm.

Buffing wheel 72 may take any of various known forms and preferably comprises a nylon and aluminum oxide impregnated soft buffing wheel of the type available from Standard Abrasives as Bright Rite E-Z Deburring Wheel Grade FS/C. Wheel 72 may have a diameter for example of eight inches and a thickness of one inch. Wheel 72 defines an annular buffing surface 72*a* on the outer peripheral edge of the wheel extending generally parallel to the axis of rotation of the wheel.

Motor 70 is pivotally mounted on frame members 34 by lugs 70*a* secured to the motor housing and journaling on a pivot shaft 80 mounted between lugs 82 on a support bar 84 extending between uprights 34.

Buffing wheel assembly 26 further includes a stop bracket 86 secured to the housing of motor 70 and coacting with a stop screw 88 mounted on a bar 90 secured to uprights 34. Buffing wheel assembly 26 will thus be seen to be gravitationally biased for clockwise pivotal movement about the axis of pivot shaft 80 with the extent of clockwise pivotal movement delimited by engagement of bracket 86 with stop screw 88.

Buffing wheel assembly 28 is generally similar to buffing wheel assembly 26 and includes a second electric motor 92 and a second buffing wheel 94 secured to the output shaft 96 of the motor 92 so that wheel 94 defines an annular buffing surface 94*a* on the outer peripheral edge of the wheel extending generally parallel to the axis of rotation of the wheel. Motor 92 and wheel 94 may be identical, respectively, to motor 70 and wheel 72. Motor 92 is mounted on a base plate 98 and base plate 98 is in turn pivotally mounted on frame members 42 by lugs 100 journaled on a pivot shaft 102 carried by lugs 104 secured to members 42. A stop screw 106 is mounted on a bar 108 secured to members 42 and is positioned in confronting relation to the undersurface of base plate 98. It will be seen that buffing wheel assembly 28 is gravitationally biased for clockwise pivotal movement about the axis of pivot shaft 102 with the extent of clockwise pivotal movement delimited by engagement of the undersurface of base plate 98 with stop screw 106.

It will be seen that the axis of rotation of buffing wheel assembly 26 and the axis of rotation of buffing wheel assembly 28 are arranged obliquely with respect to each other. It will further be seen (FIG. 5) that the pivot axes of the wheel assemblies and the stop screws of the wheel assemblies are arranged such that, in the absence of a ball joint stud positioned therebetween, the confronting peripheral buffing surfaces 94*a* and 72*a* of the buffing wheels 94 and 72 are spaced apart by a distance that is somewhat less than the diameter of the ball 10 of a ball joint stud but are free to move apart against the resistance of gravity in response to the insertion of the ball 10 of a ball joint stud 12 therebetween. The respective wheels are urged by gravity into contact with respective portions of the spherical surface of the ball 10 with the gravity force GF exerted by the wheel 72 having a vertical component $GF_v$ tending to move the ball joint stud upwardly along its central axis 66 and the gravity force GF exerted by the wheel 94 having a vertical component $GF_v$ tending to move the stud downwardly along the axis 110 so that the vertical components of the gravity forces exerted by the wheels 94 and 72 tend to counteract each other and preclude upward displacement of a ball joint stud relative to the fixture 56 in which the stud is rotatably mounted. If will be seen that the wheel 72 is arranged to engage and buff substantially the lower hemisphere 112*a* of the spherical surface of the ball 10 and the wheel 94 is arranged to engage and buff substantially the upper hemisphere 112*b* of the wheel 94 so that the wheels, in coaction, engage and buff the entire spherical surface 112 of the ball.

Figure 5:
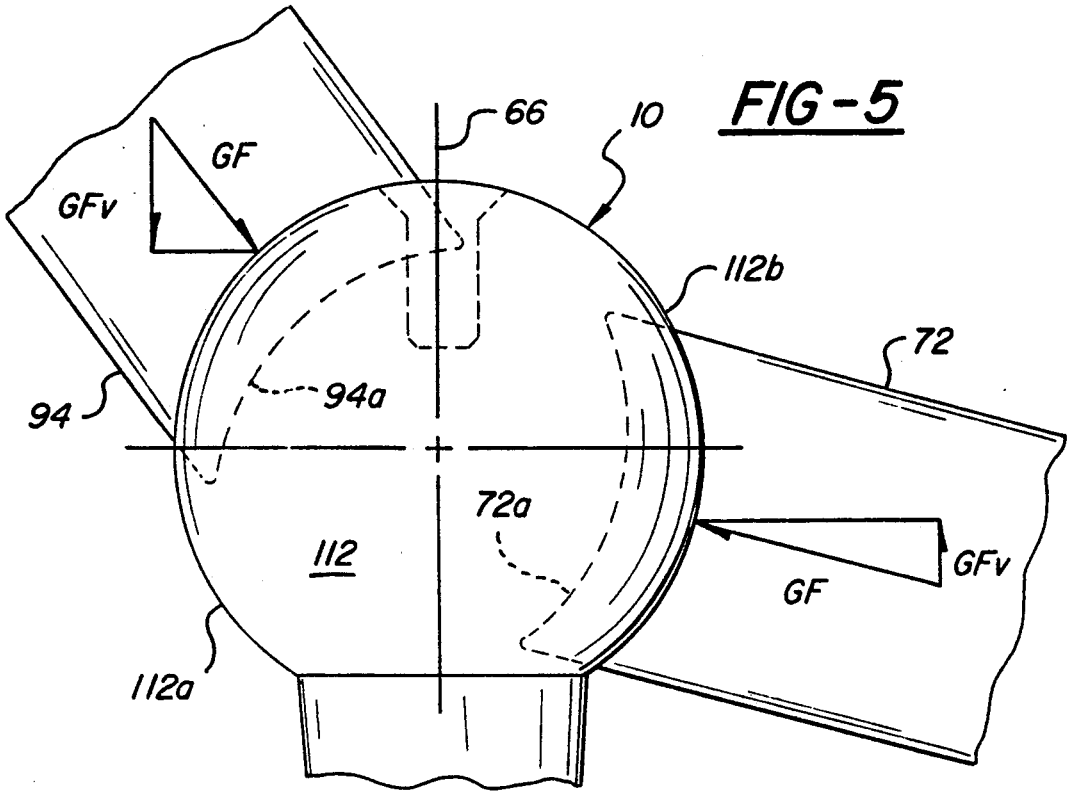
FIG. 5 is a detail view taken within the circle 5 of FIG. 4.
Figure 6:
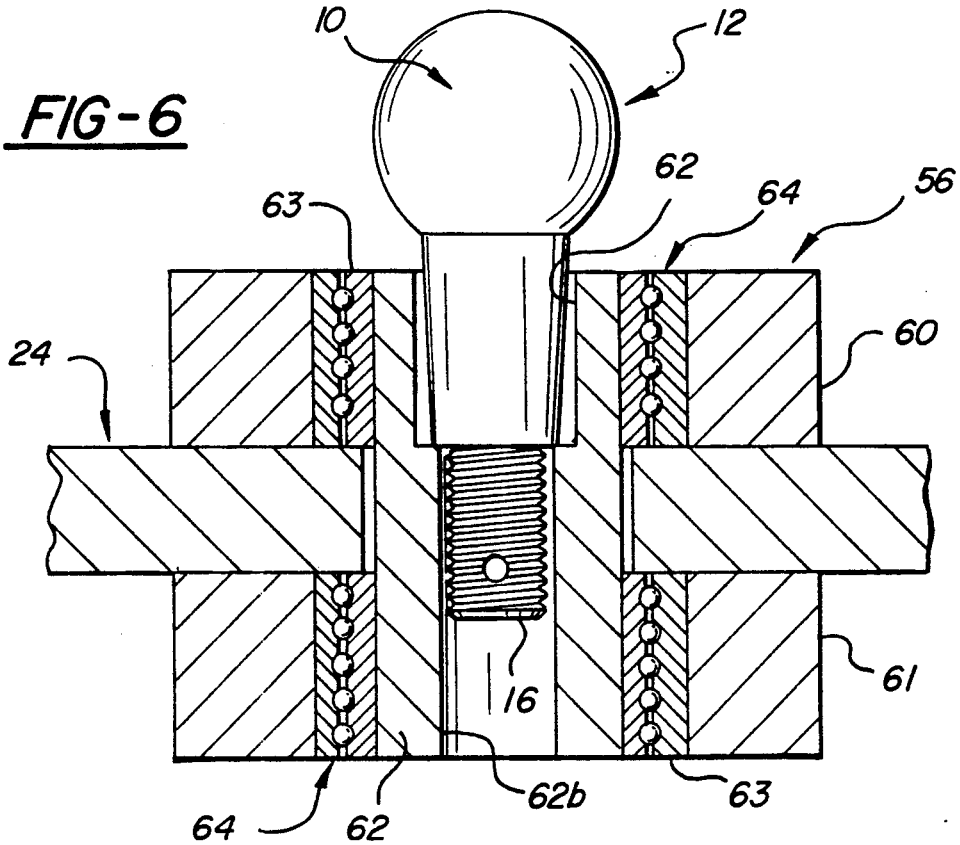
FIG. 6 is a detail view of the fixture.

In operation, index drive 22 functions in known manner to indexingly move the table 24 so as to successively and indexingly move each fixture 56 between loading stations L, a buffing station B, and an unloading station U. As each buffed ball joint stud 12 is moved from the buffing station B to the unloading station U by indexing movement of the index drive 22, peripheries 72*a*,94*a* of the buffing wheels move from their solid line buffing positions as seen in FIG. 5 to their dotted line rest positions as seen in FIG. 5 whereafter, with the subsequent arrival of the next ball joint stud as the next fixture 56 arrives at buffing station B, the ball of the stud wedges its way between the confronting peripheries of the buffing wheels and moves the wheels against the bias of gravity to their solid line buffing positions of FIG. 5. The outward pivotal movement of the wheels occurs as gravitationally resisted pivotal movement of buffing wheel assembly 26 about the axis of pivot shaft 80 and gravitational resisted pivotal movement of buffing wheel assembly 28 about the axis of pivot shaft 102.

The motors 70,92 are operated continuously during the operation of the apparatus but in a sense to rotate the wheels 72 and 94 in opposite directions so that as the ball 10 of a new ball joint stud 12 moves between the rotating wheels, the wheels act to rotate the ball joint stud about its central axis 66 so that the periphery 72*a* of wheel 72 buffs the entire lower hemisphere 112*a* of the spherical surface of the ball and the periphery 94*a* of the wheel 94 buffs substantially the entire upper hemisphere 112*b* of the spherical surface of the ball with the result that the wheels, in combination, buff the entire spherical surface of the ball to remove the oxides created by the tempering treatment of the stud. It has been found that a buffing time of only 1½ seconds is sufficient to totally remove the oxides from the ball surface and provide a finely polished finish on the ball. Accordingly, the invention apparatus is capable of finishing a large number of ball joint studs in a given unit of time with the result that the finishing cost per unit is minimal.

The invention method and apparatus will be seen to provide an effective and inexpensive means of buffing spherical portions of parts, such as the ball portions of ball joint studs, while eliminating the toxic waste problems associated with the prior art tumbling method and apparatus.

Whereas a preferred embodiment of the invention has been illustrated and described in detail, it will be apparent that various changes may be made in the disclosed embodiment without departing from the scope or spirit of the invention.

I claim:

1. A method of buffing a spherical portion of a part comprising mounting the part for rotation and engaging opposite portions of the spherical surface of the spherical portion with first and second rotating buffing wheels arranged to coact above substantially the entire spherical surface of the spherical portion of the part as the spherical portion rotates between the buffing wheels, the buffing wheels being urged by gravity against the spherical surface with one wheel arranged to exert a force on the part in one direction along an axis and the other wheel arranged to exert a counter force on the part in the opposite direction along said axis.

2. Apparatus for buffing a part having a spherical portion defining a spherical surface, said apparatus comprising:

means mounting the part for rotation with the spherical portion exposed;

a first rotating buffing wheel arranged to engage a first portion of the spherical surface of the spherical portion;

a second rotating buffing wheel arranged to engage a second opposite portion of the spherical surface of the spherical portion; and means for driving said wheels in opposite directions so as to rotate said spherical portion therebetween and buff the spherical surface;

the buffing wheels being urged by gravity against the respective portions of the spherical surface.

3. An apparatus according to claim 2 wherein the part includes a shank portion with the spherical portion at one end of the shank portion, the part is mounted for rotation about the lengthwise axis of the shank portion, one buffing wheel is arranged to exert a force on the part in one direction along said axis and the other buffing wheel is arranged to exert a counterforce on the part in the opposite direction along said axis.

4. An apparatus for buffing a part having a spherical portion defining a spherical surface, said apparatus comprising:

means mounting the part for rotation with the spherical portion exposed;

a first rotating buffing element arranged to engage a first portion of the spherical surface of the spherical portion;

a second rotating buffing element arranged to engage a second, opposite portion of the spherical surface of the spherical portion;

means for driving said elements in opposite directions so as to rotate said spherical portion therebetween and buff the spherical surface; and means for sequentially indexing successive parts into a buffing position between the buffing wheels;

said buffing wheels being gravity biased into engagement with said opposite surfaces of said spherical portion.

5. An apparatus according to claim 4 wherein the buffing wheels are normally maintained in a position where the wheels define confronting peripheries which are spaced apart by a distance less than the size of the spherical portion of the part but are free to move apart, against the force of gravity, in response to indexing movement of a part into a position between the wheels.

6. An apparatus for buffing ball joint studs having shank portions and ball portions defining spherical surfaces, said apparatus comprising:

a frame structure;

an index table;

a plurality of fixtures spaced circumferentially about the index table and each arranged to rotatably mount the shank portion of a stud, with the ball portion exposed, so that the stud may rotate about its lengthwise axis;

an index drive operative to indexingly move the table so that each fixture is moved successively through a loading station, a buffing station, and an unloading station; and first and second buffing wheels mounted on said frame structure at said buffing station with their respective peripheries arranged to buffingly engage opposed portions of the spherical surface of the ball portion of a ball joint stud moved therebetween by the index drive;

said buffing wheels being biased by gravity into contact with the respective opposite surfaces of the ball portion of the ball joint stud.

7. An apparatus according to claim 6 wherein one buffing wheel is arranged to exert a force on the stud in one direction along said axis and the other buffing wheel is arranged to exert a counterforce on the stud in the opposite direction along said axis.

8. An apparatus according to claim 7 wherein the apparatus further includes first and second electric motors respectively driving said first and second buffing wheels and pivotally mounted on said frame structure in a manner to gravitationally urge the respective wheels into engagement with the ball portion.

9. An apparatus according to claim 8 wherein said wheels are arranged to rotate about axes that are obliquely arranged with respect to each other.

10. An apparatus according to claim 9 wherein said wheels are arranged so that one wheel engages substantially one hemisphere of the spherical surface of the ball portion and the other wheel engages substantially the other hemisphere of the spherical surface of the ball portion.

* * * * *